US009715985B2

(12) United States Patent
Neuhaus et al.

(10) Patent No.: US 9,715,985 B2
(45) Date of Patent: Jul. 25, 2017

(54) ELECTRIC SWITCH

(71) Applicant: Tyco Electronics Austria GmbH, Vienna (AT)

(72) Inventors: Alexander Neuhaus, Vienna (AT); Johannes Helmreich, Zwettl (AT); Christoph Hauer, Vitis (AT)

(73) Assignee: Tyco Electronics Austria GmbH, Vienna (AT)

( * ) Notice: Subject to any disclaimer, the term of this patent is extended or adjusted under 35 U.S.C. 154(b) by 0 days.

(21) Appl. No.: 14/861,430

(22) Filed: Sep. 22, 2015

(65) Prior Publication Data

US 2016/0012997 A1 Jan. 14, 2016

Related U.S. Application Data

(63) Continuation of application No. PCT/EP2014/055473, filed on Mar. 19, 2014.

(30) Foreign Application Priority Data

Mar. 22, 2013 (EP) ..... 13160662

(51) Int. Cl.
*H01H 77/10* (2006.01)
*H01H 1/28* (2006.01)
(Continued)

(52) U.S. Cl.
CPC ..... *H01H 77/101* (2013.01); *H01H 1/28* (2013.01); *H01H 50/56* (2013.01); *H01H 50/58* (2013.01)

(58) Field of Classification Search
CPC ..... H01H 1/28; H01H 50/58; H01H 77/101; H01H 50/56
See application file for complete search history.

(56) References Cited

U.S. PATENT DOCUMENTS 6,046,661 A * 4/2000 Reger ..... H01H 50/643 335/185
7,902,948 B2 * 3/2011 Luders ..... H01H 9/346 218/146
(Continued)

FOREIGN PATENT DOCUMENTS

CN 2715327 Y 8/2005
DE 202010005964 U1 7/2010
(Continued)

OTHER PUBLICATIONS

Abstract of EP 2131377, dated Dec. 9, 2009, 2 pages.
(Continued)

*Primary Examiner* — Mohamad Musleh
(74) *Attorney, Agent, or Firm* — Barley Snyder

(57) ABSTRACT

An electric switch is disclosed. The electric switch includes first and second terminals, and a contact sub-assembly is disposed between the first and second terminals and includes at least two contact members. The contact sub-assembly has a connecting position in which the contact members contact each other, wherein a current path extends from the first terminal to the second terminal through the contact sub-assembly in the connecting position, and an interrupting position in which the contact members are spaced apart from each other, wherein the current path does not extend from the first terminal to the second terminal in the interrupting position. At least two conductor members are disposed in the current path between the first terminal and the contact sub-assembly, and the current generates a Lorentz force between the conductor members that is mechanically translated to bias the contact sub-assembly into the interrupting position.

16 Claims, 3 Drawing Sheets

(51) Int. Cl.
*H01H 50/56* (2006.01)
*H01H 50/58* (2006.01)

(56) References Cited

U.S. PATENT DOCUMENTS

| | | | | |
|---|---|---|---|---|
| 8,203,403 | B2 * | 6/2012 | Moeller | H01H 50/642 335/129 |
| 2004/0080388 | A1 * | 4/2004 | Schmelz | H01H 51/2227 335/128 |
| 2009/0033446 | A1 * | 2/2009 | Gruner | H01H 1/26 335/129 |
| 2009/0033447 | A1 * | 2/2009 | Gruner | H01H 51/2281 335/189 |

FOREIGN PATENT DOCUMENTS

| | | | | |
|---|---|---|---|---|
| DE | WO 2012028383 | A1 * | 3/2012 | H01H 9/44 |
| EP | 2131377 | A1 | 9/2009 | |
| EP | 2551868 | A1 | 1/2013 | |
| WO | 2010090618 | A2 | 8/2010 | |

OTHER PUBLICATIONS

International Search Report, Intl Application No. PCT/EP2014/055473, 3 pages, dated May 20, 2014.
English translation of Chinese First Office Action, dated Sep. 13, 2016, 10 pages.
Chinese Office Action, dated Sep. 13, 2016, 7 pages.
Abstract of CN2715327, dated Aug. 3, 2005, 2 pages.

* cited by examiner

ELECTRIC SWITCH

CROSS-REFERENCE TO RELATED APPLICATIONS

This application is a continuation of PCT International Application No. PCT/EP2014/055473 filed Mar. 19, 2014, which claims priority under 35 U.S.C. §119 to EP13160662.6 filed Mar. 22, 2013.

FIELD OF THE INVENTION

The invention relates to an electric switch, and more particularly to an electric switch actuated by a Lorentz force.

BACKGROUND

Electric switches, such as relays, in which two contact members are moved between a connecting position creating a current path and an interrupting position interrupting the current path are known in the art.

A Lorentz force is the sum of electric and magnetic forces exerted on a point charge, for example, the electric and magnetic force on a current-carrying wire. It is also known to create a Lorentz force within an electric switch, specifically to increase the contact pressure between the contact members. Known switches, however, are actuated by mechanical forces and thus experience mechanical abrasion and wear that decreases longevity.

SUMMARY

The object of the invention is to provide an electric switch that is reliable over a larger number of switching cycles. The electric switch includes first and second terminals, and a contact sub-assembly is disposed between the first and second terminals and includes at least two contact members. The contact sub-assembly has a connecting position in which the contact members contact each other, wherein a current path extends from the first terminal to the second terminal through the contact sub-assembly in the connecting position, and an interrupting position in which the contact members are spaced apart from each other, wherein the current path does not extend from the first terminal to the second terminal in the interrupting position. At least two conductor members are disposed in the current path between the first terminal and the contact sub-assembly, and the current generates a Lorentz force between the conductor members that is mechanically translated to bias the contact sub-assembly into the interrupting position.

BRIEF DESCRIPTION OF THE DRAWINGS

The invention will now be described by way of example with reference to the accompanying figures, of which.

DETAILED DESCRIPTION OF THE EMBODIMENT(S)

The invention is described in detail below with reference to embodiments of an electric switch. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 2:
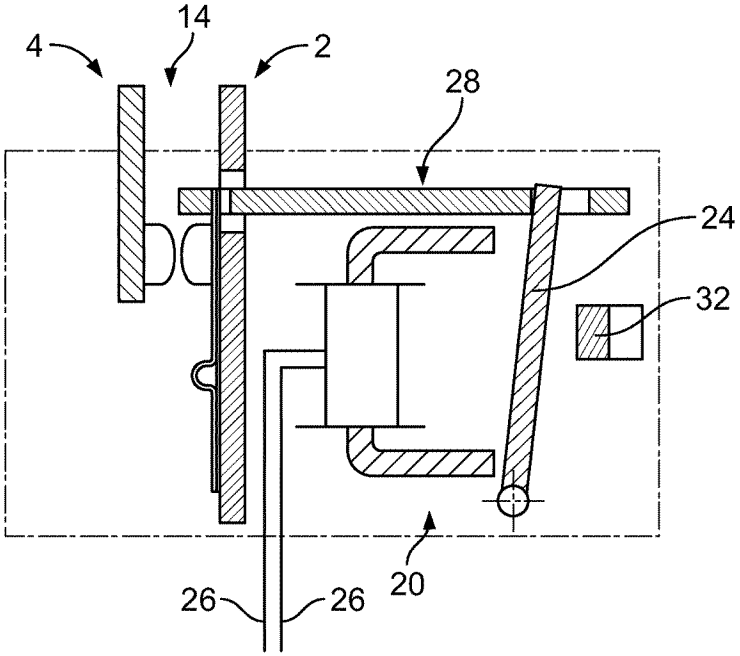
FIG. 2 shows a schematic side view of the electric switch in an interrupting position according to an embodiment of the invention.

The configuration of the electric switch according to an embodiment of the invention is first explained with reference to FIGS. 1 and 2. In FIG. 2, some of the reference signs of FIG. 1 have been omitted for clarity.

The electric switch 1 comprises a first terminal 2 and a second terminal 4, which may be electrically connected to machinery or circuitry (both not shown). The electric switch 1 further comprises a contact sub-assembly 6, which includes at least two contact members 8, 10. The contact sub-assembly 6 may be moved from a connecting position 12, in which in the contact members 8, 10 contact each other, to an interrupting position 14 shown in FIG. 2. In the interrupting position 14, the contact members 8, 10 are spaced apart from each other. In the connecting position 12, a current path 16 extends between the first and second terminals 2, 4. Thus, an electric current may flow between the first and second terminals 2, 4 along the current path 16. In the interrupting position 14, the current path is interrupted at the contact sub-assembly 6 and no current may flow between the terminals 2, 4.

The electric switch 1 further comprises a Lorentz force generator 18, which is explained further below with reference to FIGS. 3 and 4. The Lorentz force generator 18 may be connected in series to the contact sub-assembly 6. It may be located in the current path 16 in front of or behind the contact sub-assembly 6.

Figure 1:
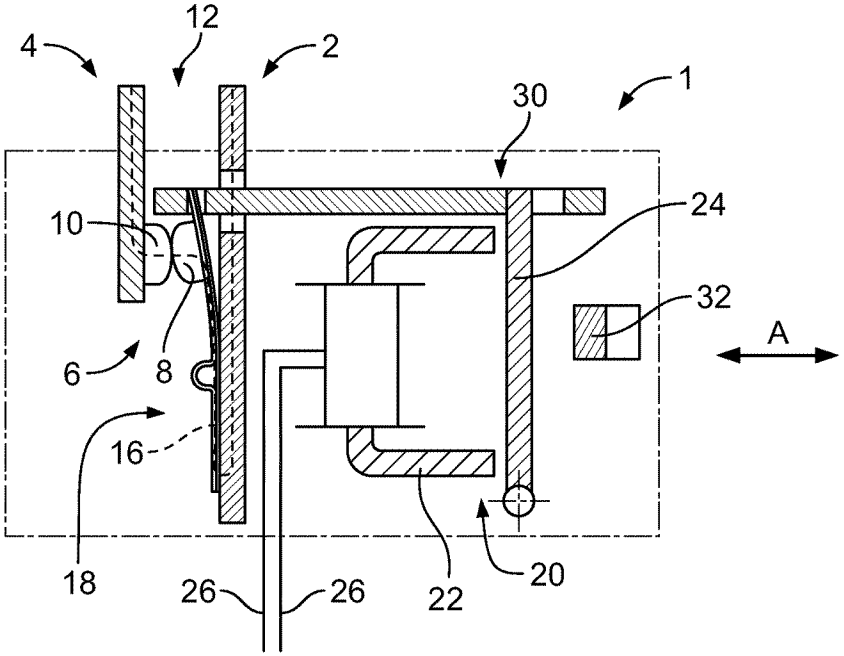
FIG. 1 shows a schematic side view of an electric switch in a connecting position according to an embodiment of the invention.

As shown in FIGS. 1 and 2, the electric switch 1 may further comprise an actuator sub-assembly 20, which may be configured to drive the contact sub-assembly 6 from the connecting position 12 to the interrupting position 14 and back. The actuator sub-assembly 20 comprises an electromagnetic drive system 22 that acts upon an armature 24, which is moved depending on an electromagnetic field generated by the electromagnetic drive system 22. The actuator sub-assembly may be driven upon switching signals applied to at least one control terminal 26.

The actuator sub-assembly 20 is shown in FIG. 2 in an open position 28, which is associated with the interrupting position 14 of the contact sub-assembly 6 if the Lorentz force generator 18 is inactive. A closed position 30 of the actuator sub-assembly 20 is associated with the connecting position 12 of the contact sub-assembly 6, as shown in FIG. 1.

The actuator sub-assembly 20 is at least mono-stable in the open position 28. Thus, the actuator sub-assembly 20 rests stably in the open position 28 if no external forces act on the actuator sub-assembly 20 or no external energy is supplied to the control terminal 26. In other embodiments, the actuator sub-assembly 20 may have more than one stable position, i.e. may be bi- or tri-stable, or may have even more stable states. In a bi-stable configuration, for example, the closed position 30 may also be stable.

In the present example, the stability of the actuator sub-assembly 20 is achieved by positioning a magnet 32 in the vicinity of the armature 24, such that the armature 24 stays attracted by the magnet 32 in the interrupting position 14. Other means than a magnet 32, such as a spring, may also lead to a stable open position 28. For attaining the closed position 30, it may be sufficient that the electromagnetic field of the electromagnetic drive system 22 collapses, so that the attractive force of the magnet 32 automatically moves the armature 24 to the open position 28 as shown in FIG. 2.

To move the armature 24 from the open position 28 to the closed position 30, the electromagnetic drive system 22 has to build up an electromagnetic field which exerts a force counteracting the attractive force of the magnet 32 on the armature 24. If the force generated by the electromagnetic drive system 22 overcomes the attractive force of the magnet 32, the armature 24 will move into the closed position 30 and thereby drive the contact sub-assembly 6 from the interrupting position 14 to the connecting position 12. The double-ended arrow A indicates the ability of the electric switch 1 to move between the connecting position 12 and the interrupting position 14.

In the following, the configuration of the Lorentz force generator 18 is explained with reference to FIGS. 3 and 4. To keep the figures simple, some of the reference numerals of FIGS. 1 and 2 have been omitted.

Figure 3:
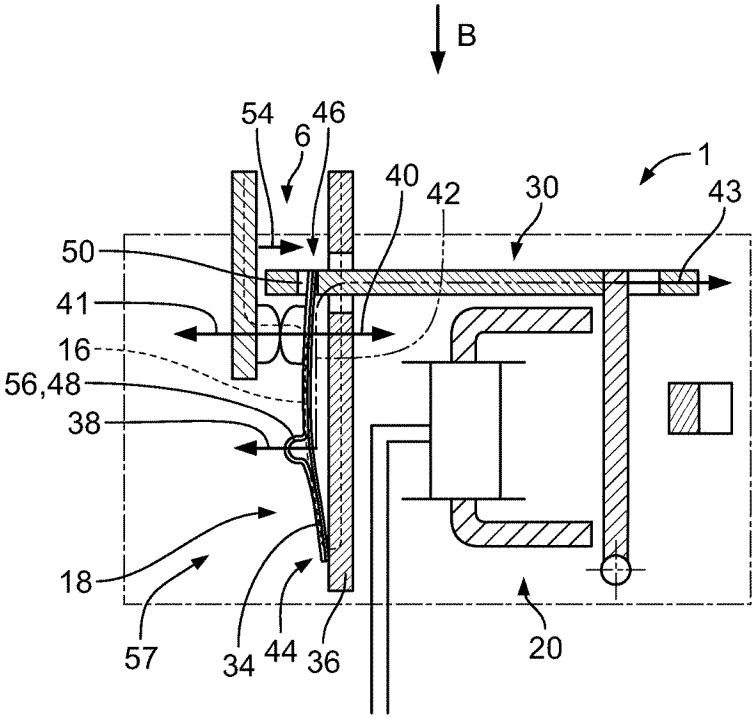
FIG. 3 shows a schematic side view of the electric switch in a triggered, closed state according to an embodiment of the invention.

FIG. 3 shows the contact sub-assembly 6 in the connecting position, and the actuator sub-assembly 20 in the closed position 30. The Lorentz force generator 18 comprises at least two conductor members 34, 36. The conductor members 34, 36 are located in the current path 16. If an electric current is applied along the current path 16, a Lorentz force 38 is generated which acts between the conductor members 34, 36. The at least two conductor members 34, 36 of the Lorentz generator 18 extend parallel and adjacent to each other, as shown in the figures. This ensures that the Lorentz force 38 is generated with maximum efficiency. The direction of the Lorentz force depends on the direction of the current in the conductor members 34, 36. If the current is of the same direction in the conductor members 34, 36, the Lorentz force 38 will act in a direction opposite to the arrow 38 in FIG. 3 to attract the conductor members 34, 36 to each other. Thus, the Lorentz force 38 may directly act on the contact sub-assembly 6 as an opening force 40 via the conductor member 34, which is connected to the contact member 8.

In the embodiment shown in FIG. 3, the direction of the current in the conductor member 34 is opposite to the direction of the current in the conductor member 36. Thus, the Lorenz force 38 will push the conductor members 34, 36 apart. The immediate effect of the Lorentz force 38 will thus result in a closing force 41 at the contact members 8, 10, via the conductor member 34.

However, the Lorentz force 38 can also be translated into the opening force 40, in the reverse direction, by being translated along a force-flux path 42. The mechanical translation may, for example, be effected by mechanically linking the Lorentz force generator 18 to the contact sub-assembly 6, so that the Lorentz force is translated along the mechanical linkage. In such a configuration, the Lorentz force acts along the force-flux path 42. As explained below, the mechanical translation may involve the generation of an intermediate actuating force 43 which is used to operate the actuator sub-assembly 20. The actuator sub-assembly 20 may also generate the opening force 40 upon operation.

As shown in FIG. 3, at least one of the conductor members 34, 36 may be configured to be deflected by the Lorentz force 38 relative to an initial currentless state, which may be the open state 14 shown in FIG. 2. In order to accommodate the deflection of the conductor member 34, an unobstructed deflector volume 57 may be provided adjacent to the Lorentz force generator 18. In the deflected state, the conductor member 34 extends into the deflector volume 57. By way of example only, it is the conductor member 34 which is deflected by the Lorentz force 38, and the following describes the conductor member 34 in more detail with reference to FIGS. 3 and 4.

The deflectable conductor member 34 is fixed at one end 44, while the other end 46 is moveable. If the conductor members 34, 36 are fixed to each other at the fixed end 44 of the conductor member 34, the conductor members 34, 36 may be connected in series within the current path 16. The deflection of the conductor member 34 may in particular be an elastic deformation. If this is the case, the conductor member 34 is a trigger spring 48, of which the deflection will trigger the opening of the contact sub-assembly 6. A contact spring may be used as the trigger spring 48.

If the conductor member 34 is in the deflected state, the moveable end 46 may be supported by the contact sub-assembly 6 in the triggered, closed state as shown in FIG. 3. The deflection due to the Lorentz force 38 may lead to a curved shape of the conductor member 34 due to the two support points at the fixed end 44 and at the contact sub-assembly 6.

According to an embodiment of the invention shown in FIGS. 1-4, the Lorentz force generator 18 is used as part of a safety release mechanism, which automatically transfers the contact sub-assembly 6 from the connecting position 12 to the interrupting position 14 if an over-current is or has been present in the current path 16. As the amount of deflection of the at least one deflectable conductor member 34 depends on the strength of the current running through the current path 16, the disruption of the current path 16 at the contact sub-assembly 6 is initiated if a predefined maximum deflection is exceeded.

The Lorentz force 38 acts indirectly on the contact sub-assembly 6 to accomplish this transfer from the connecting position 12 to the interrupting position 14. The Lorentz force generator 18 is mechanically linked to the actuator sub-assembly 20, so that the Lorentz force 38 acts on the actuator sub-assembly 20. The linkage may be realized by mechanically coupling the deflectable conductor member 34 directly to the actuator sub-assembly 20. In the present example, however, the Lorentz force generator 18 is only indirectly coupled to the actuator sub-assembly 20 in that an over-stroke spring 50 is arranged in between.

The over-stroke spring 50 forms an actuating lever 52 together with the conductor member 34; the contact sub-assembly 6 acts as a pivot support for the actuating lever 52. Thus, the deflection of the deflectable conductor member 34 due to the Lorentz force 38 leads to a pivoting motion of the actuating lever 52 about the contact sub-assembly 6. The Lorentz force 38 effects both a pressing together of the contact members 8, 10 by the closing force 43, and a pivoting motion at the side of the actuating lever 52 opposite the Lorentz force generator 18 with respect to the contact sub-assembly 6. Consequently, the over-stroke spring 50 is moved in the opposite direction as indicated by the arrow 43. Thus, due to the lever-like structure, the Lorentz force 38 is translated at the end of the over-stroke spring 50 into the actuating force 43 of different strength and opposite direction. Via the over-stroke spring 50 and the actuating force 43, the actuator sub-assembly 20 is biased into the open position 28, shown in FIG. 4.

If the switch 1 is mono-stable, a very small force acting on the actuator sub-assembly 20 may be sufficient to move it into the open position 28. In case of a bi-stable actuator sub-assembly 20, which rests stably also in the closed position, the Lorentz force 38, or, more specifically, the actuating force 43 derived therefrom, will need to exceed a threshold for moving the actuator sub-assembly 20 out of the stable closed position.

Figure 4:
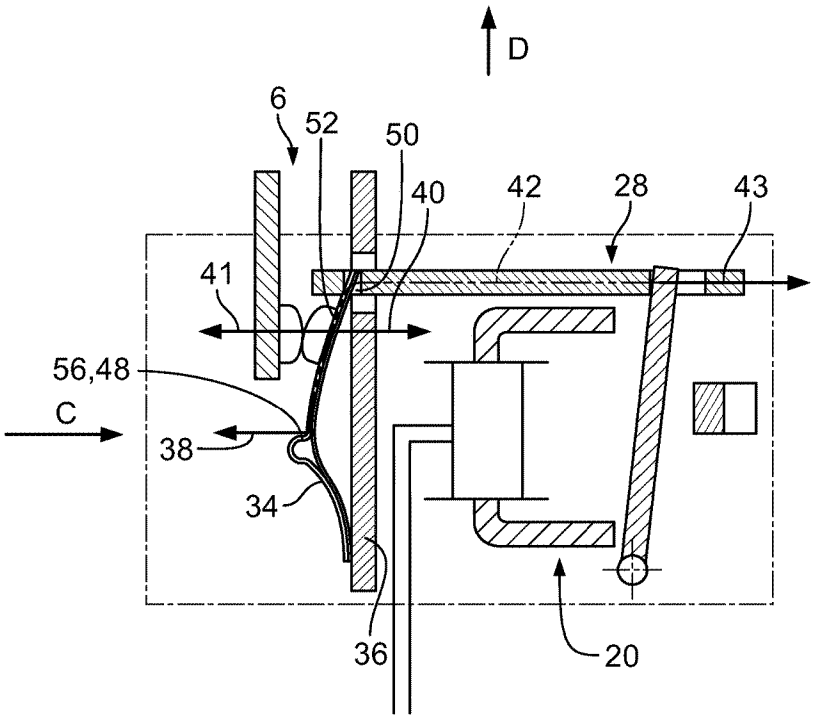
FIG. 4 shows a schematic side view of the electric switch in a triggered, open state according to an embodiment of the invention.

In FIG. 4, the actuator sub-assembly 20 has been triggered and moved into the open position 28 by the Lorentz force 38. In the present embodiment, a spring member 56, such as the over-stroke spring 50, or the trigger spring 48, is arranged between the actuator sub-assembly 20 and the contact sub-assembly 6. Thus, the actuator sub-assembly 20 may assume the open position 28, while the contact sub-assembly 6 still rests in the connecting position 14. This is only possible if the intermediate spring member 56 is loaded.

In the present case, where the trigger spring 48 doubles as an intermediate spring member 56, the deformation of the trigger spring 48 is increased if the actuator sub-assembly 20 is in the open position 28 and the contact sub-assembly 6 is the connecting position 12. As the actuator sub-assembly 20 is stable in the open position 28, it will keep the intermediate spring member loaded until the contact sub-assembly 6 is moved into the interrupting position 14. The load of the spring member 56, is now independent of the Lorentz force and thus from the electric current in the current path 16.

The Lorentz force generator 18 then initiates the transition from the closed position 12 to the open position 14 if the current in the current path 16 has decreased. The Lorentz force acts in the contact sub-assembly 6 and overcompensates the opening force 40 generated by the Lorentz force 38 in the Lorentz force generator 18 if the current in the current path 16 is large enough. If the electric current decreases, the Lorentz force acting in the contact sub-assembly 6 will also decrease until the opening force 40 generated by the spring member 56 is stronger. If this is the case, the contact members 8, 10 will be separated and the trigger spring 48 will relax. The switch will assume the state shown in FIG. 2 after starting in the state shown in FIG. 4, the transition indicated by arrow D.

Thus, the embodiment shown in FIGS. 1 to 4 uses a cascading system where the Lorentz force is not directly acting on the closed contact sub-assembly 6 but is used first to deflect the trigger spring 48, shown in the arrow B transition from FIG. 1 to FIG. 3, and then used to transfer the actuator sub-assembly 20 into a stable open position 28, while the contact sub-assembly 6 is still in the connecting position 12, shown in the arrow C transition from FIG. 3 to FIG. 4. This will load the spring member 56 which is operatively arranged between the actuator sub-assembly 20 and the contact sub-assembly 6 and generate the opening force 40 to transition back to FIG. 2.

As the actuator sub-assembly 20 rests stably in the open position 28 independent of the current in the current path 16, the opening force 40 will be applied if the current in the current path 16 has decreased. The decrease of the current in the current path 16 will also decrease the local Lorentz force which acts within the contact sub-assembly 6 and presses the contact members 8, 10 together. If the opening force 40 exceeds the local Lorentz force, the contact sub-assembly 6 will be transferred into the interrupting position 14 of FIG. 2.

Figure 5:
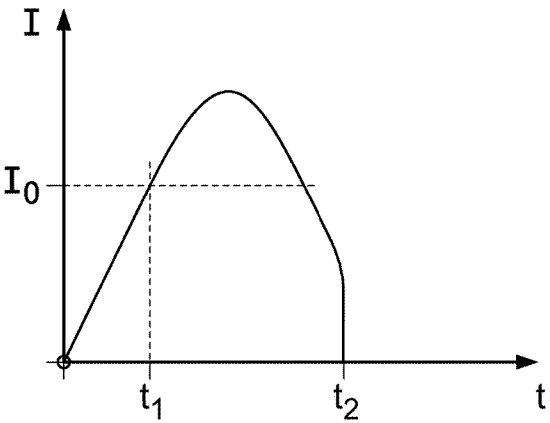
FIG. 5 shows the current in the electric switch over time according to an embodiment of the invention.

FIG. 5 shows the behavior of current I over time t. At a time $t_1$, an over-current $I_O$ occurs. While the over-current is present $I_O$, the switch 1 is transferred into the triggered state, as shown in FIGS. 3 and 4. If the current further decreases, the opening force 40 will pry the contacts apart at a time $t_2$ and interrupt the current path 16, transitioning back to FIG. 2. Thus, starting from time $t_2$, the current I in the current path 16 will be zero. By carefully adjusting the properties of the spring member 56, the interruption of the current path 16 can be set close to a zero current, i.e. I=0.

As the Lorentz force 38 is generated by the Lorentz force generator 18 independent of whether alternating (AC) or direct current (DC) is used, the switch 1 may be used both for AC and DC applications.

In an alternative embodiment, if the currents in the current path 16 are expected to be low such that no switching arc will occur upon separation of the contact members 8, 10, it may not be necessary to use the cascading system as discussed above. Instead, the Lorentz force 38 may be used to directly open the contact members 8, 10; leaving the actuator sub-assembly 20 open and transitioning only between FIGS. 2 and 4.

Further, the actuator sub-assembly 20 does not need to be an actuator sub-assembly 20 that is used to drive the contact sub-assembly 6 upon external signals. It may be configured to be solely driven by the Lorentz force generator 18.

The flexibility of the trigger spring 48 has to be adjusted depending on the over-current $I_O$ which leads to the triggered state. As large currents need a large cross-section in the current path 16, the trigger spring 48 may be provided with a mid-section of increased deflectability. This is explained with reference to FIG. 6.

Figure 6:
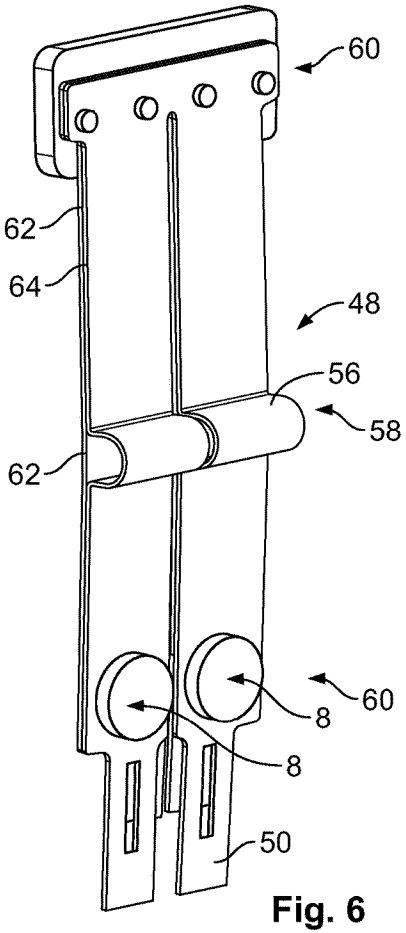
FIG. 6 shows a perspective view of a trigger spring used in an embodiment of the invention.

In FIG. 6, the trigger spring 38 is shown without the remaining elements of the switch 1. For large currents, the trigger spring 48 may be divided in two or more parallel sections. The trigger spring 48, doubling as a contact spring, may be provided with two contact members 8 and the over-stroke spring 50 opposite the fixed end. At a mid-section 58, which is located between two neighboring end sections 60 of the trigger spring 38, deflectability may be increased. If the trigger spring 48 comprises two or more layers 62, 64, the layers may be separated at the mid-section 58, e.g. by bending the layer 56 while keeping the layer 62, 64 straight. This will ensure high flexibility of the trigger spring 48 in spite of large cross-sections needed for high current.

The above-described embodiments of the invention are advantageous in that the opening of the contact members 8, 10 is effected when no or a low current is in the current path 16. Thus, there is no danger of a switching arc being generated if the contact members 8, 10 start to separate. Therefore, the embodiment shown in FIGS. 1 to 4 is especially suited for high-current applications where several thousand amperes are running along the current path 16. But, with accordingly defined relationships of the parts, the function may also be possible with lower currents. Furthermore, the above-described embodiments increase switch longevity by using an electric actuating force, thereby avoiding mechanical wear.

What is claimed is:

1. An electric switch, comprising:

first and second terminals;

a contact sub-assembly disposed between the first and second terminals and including at least two contact members, the contact sub-assembly having a connecting position in which the contact members contact each other, wherein a current path extends from the first terminal to the second terminal through the contact sub-assembly in the connecting position, and an interrupting position in which the contact members are spaced apart from each other, wherein the current path does not extend from the first terminal to the second terminal in the interrupting position;

at least two conductor members disposed in the current path between the first terminal and the contact sub-assembly, wherein the current generates a Lorentz force between the conductor members deflecting at least one of the conductor members; and an actuator sub-assembly connected to the deflected conductor member, the actuator sub-assembly moved by the deflected conductor member from a first position to a second position.

2. The electric switch of claim 1, wherein the at least two conductor members extend parallel and adjacent to each other in the absence of the Lorentz force.

3. The electric switch of claim 1, wherein the deflected conductor member has a fixed end and a moveable end opposite the fixed end.

4. The electric switch of claim 3, wherein the at least two conductor members are fixed to one another at the fixed end.

5. The electric switch of claim 3, wherein the deflected conductor member includes a spring configured to be deformed elastically.

6. The electric switch of claim 5, wherein the deflected conductor member forms a lever at the moveable end.

7. The electric switch of claim 6, wherein the deflected conductor member is connected to a contact member, and the contact sub-assembly is the bearing point for the lever.

8. The electric switch of claim 7, wherein the Lorentz force moves the lever via the deflection of the deflected conductor member.

9. The electric switch of claim 8, wherein the actuator sub-assembly is connected to the deflected conductor member at the moveable end.

10. The electric switch of claim 9, wherein the spring moves the contact sub-assembly into the interrupting position when the actuator sub-assembly is in the second position.

11. The electric switch of claim 10, wherein the spring moves the contact sub-assembly into the interrupting position when the current is zero.

12. The electric switch of claim 10, wherein the actuator sub-assembly is stable in the second position.

13. The electric switch of claim 9, wherein the actuator sub-assembly includes an electromagnetic drive system and a magnet.

14. The electric switch of claim 1, further comprising an open volume adjacent to the deflected conductor member.

15. A method for actuating an electric switch, comprising:

applying a first current to two conductor members to generate a Lorentz force separating the two conductor members, wherein the separation of the conductor members connects a current path between a first terminal and a second terminal;

applying a lower second current to the two conductor members to generate a Lorentz force not separating the two conductor members, wherein the non-separated conductor members interrupt the current path between the first terminal and the second terminal.

16. A method for actuating an electric switch, comprising:

moving into contact two contact members disposed between a first terminal and a second terminal to connect a current path between the first and second terminals;

applying a first current to two conductor members connected to a contact member to generate a Lorentz force separating the two conductor members;

applying a lower second current to the two conductor members to generate a Lorentz force not separating the two conductor members, wherein the non-separated conductor members separate the two contact members and interrupt the current path between the first terminal and the second terminal.

* * * * *